US009108287B2

(12) United States Patent
Himmelsbach

(10) Patent No.: US 9,108,287 B2
(45) Date of Patent: Aug. 18, 2015

(54) METHOD FOR GRINDING THE MAIN AND ROD BEARING OF A CRANKSHAFT BY EXTERNAL CYLINDRICAL GRINDING

(75) Inventor: Georg Himmelsbach, Haslach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 566 days.

(21) Appl. No.: 13/505,941

(22) PCT Filed: Oct. 21, 2010

(86) PCT No.: PCT/EP2010/065890

§ 371 (c)(1),
(2), (4) Date: Jun. 1, 2012

(87) PCT Pub. No.: WO2011/054679

PCT Pub. Date: May 12, 2011

(65) Prior Publication Data

US 2012/0238187 A1 Sep. 20, 2012

(30) Foreign Application Priority Data

Nov. 3, 2009 (DE) ..... 10 2009 051 737

(51) Int. Cl.

| | |
|---|---|
| ***B24B 1/00*** | (2006.01) |
| ***B24B 5/42*** | (2006.01) |
| ***B24B 27/00*** | (2006.01) |
| *B24B 41/06* | (2012.01) |

(52) U.S. Cl.

CPC . *B24B 1/00* (2013.01); *B24B 5/421* (2013.01); *B24B 27/0023* (2013.01); *B24B 5/42* (2013.01); *B24B 41/061* (2013.01)

(58) Field of Classification Search

CPC ..... B24B 5/04; B24B 5/42; B24B 5/421; B24B 41/061; B24B 1/10

USPC ..... 451/49, 57, 58, 62, 246, 249, 251

See application file for complete search history.

(56) References Cited

U.S. PATENT DOCUMENTS

| | | | | |
|---|---|---|---|---|
| 6,257,972 | B1 | 7/2001 | Lessway | |
| 6,878,043 | B1 | 4/2005 | Junker | |
| 7,530,882 | B2 * | 5/2009 | Soma et al. | 451/11 |
| 2004/0248502 | A1 * | 12/2004 | Junker | 451/11 |
| 2010/0173565 | A1 * | 7/2010 | Junker | 451/11 |
| 2010/0203805 | A1 * | 8/2010 | Junker | 451/5 |
| 2011/0003534 | A1 | 1/2011 | Himmelsbach | |
| 2012/0164926 | A1 * | 6/2012 | Himmelsbach | 451/397 |

FOREIGN PATENT DOCUMENTS

| | | |
|---|---|---|
| DE | 10 2008 007 175 | 10/2009 |
| EP | 1 181 132 | 2/2002 |
| JP | 58-022606 | 2/1983 |
| JP | 2003-340693 | 12/2003 |

* cited by examiner

*Primary Examiner* — Timothy V Eley
(74) *Attorney, Agent, or Firm* — Jordan and Hamburg LLP

(57) ABSTRACT

Crankshaft rod bearings are pre-ground and finish-ground in a first grinding station and the crankshaft main bearings are then pre-ground and finish-ground in a second grinding station. The crankshaft is first mounted centered between the two points of the rotary drive. The chuck has two support members which can be moved in the radial direction and which are then positioned against the main bearing in a self-equalizing manner. In the engaged position, the support members are locked tightly to the chuck by locking pins. A pivoting clamping member is then clamped with the operating end thereof against the main bearing.

8 Claims, 5 Drawing Sheets

Figure 1:
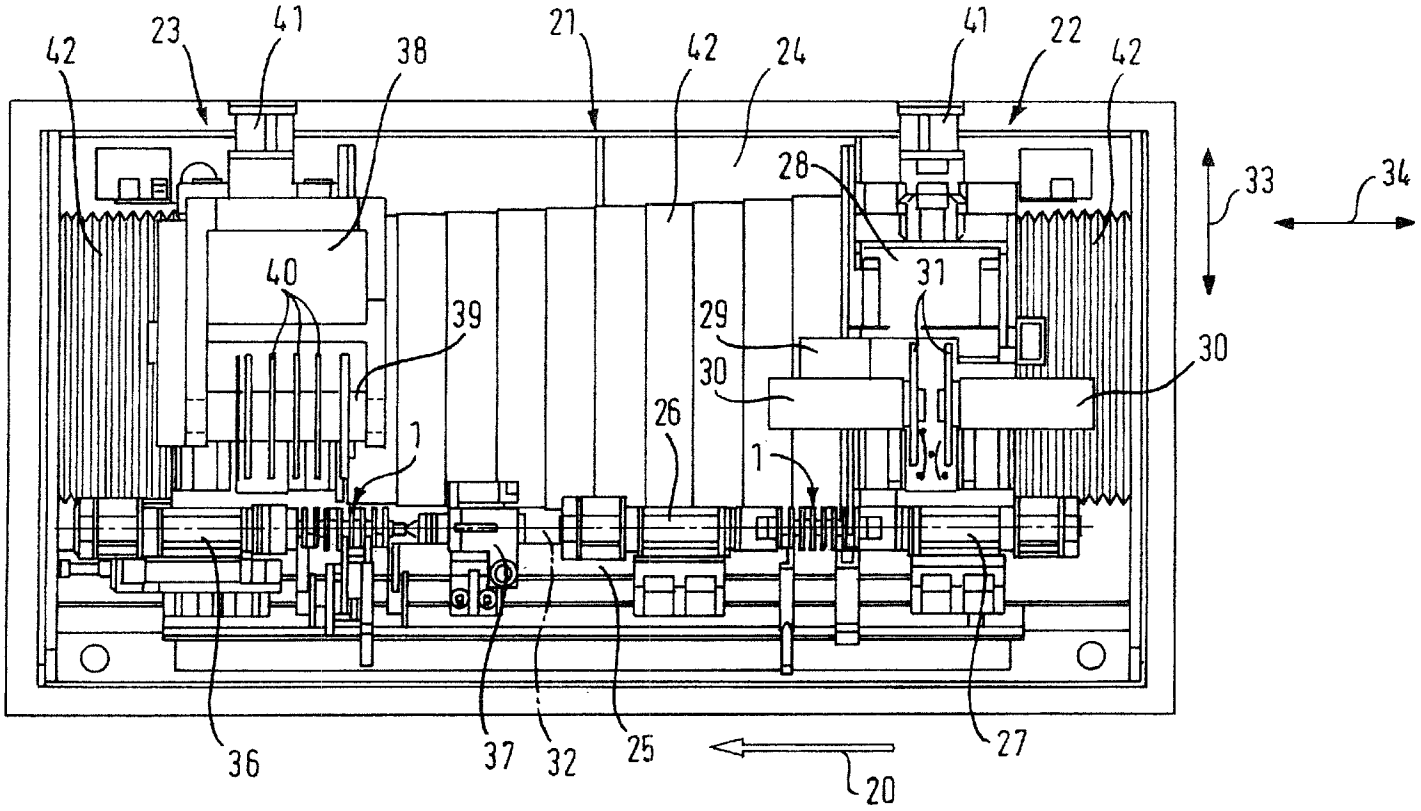

METHOD FOR GRINDING THE MAIN AND ROD BEARING OF A CRANKSHAFT BY EXTERNAL CYLINDRICAL GRINDING

BACKGROUND OF THE INVENTION

The invention relates to a method for grinding the main and rod bearings of a crankshaft by external cylindrical grinding in a grinding machine and to a grinding machine for carrying out the method. A method and a grinding machine of the type mentioned are known from DE 10 2008 007 175 A1.

It has already been proposed in EP 1 181 132 B1 to finish-grind the rod bearings before the main bearings during the external cylindrical grinding of the main and rod bearings of a crankshaft. This proposal is based on the knowledge that the considerable deformations of the crankshaft during the grinding of the rod bearings can be at least partly eliminated again during the subsequent finish-grinding of the main bearings. However, it was assumed here that the rough-grinding of the main bearings still had to take place before the grinding of the rod bearings. Therefore, according to EP 1 181 132 B1, first of all a steady-rest seat has to be initially ground onto a main bearing of the crankshaft, in order that the main bearings can be rough-ground with the required accuracy. To this end, the crankshaft has to clamped with a precisely defined rotational axis, specifically its defining geometrical longitudinal axis, which is the defining reference axis for all the main bearings with regard to diameter, roundness, true running and centricity. This defining geometrical longitudinal axis also has to be available as reference axis for the machining of the rod bearings. Following the rough- and finish-grinding of the rod bearings, the main bearings of the crankshaft are finally finish-ground. The method known from EP 1 181 132 B1 has the advantages that all of the grinding operations can be carried out in a single setup.

However, the constraints that arise on account of the clamping and supporting of the crankshaft during grinding have introduced the risk of other deformations, as is described in detail in DE 10 2008 007 175 A1. Therefore, as a remedy, that citation proposed giving up the grinding of the crankshaft in a single setup. Rather, according to DE 10 2008 007 175 A1, two grinding stations, which can be located within a single grinding machine, are proposed. First of all, the rod bearings are rough- and finish-ground in the first grinding station. Subsequently, the crankshaft is transferred into the second grinding station, in which the main bearings are rough- and finish-ground. The particular feature of the known method is that the crankshaft to be ground is clamped in the two grinding stations with its rough contour merely machined by chip removal. In this case, the cylindrical circumferential surfaces of the crankshaft are machined primarily by turning, drilling or trochoidal milling, that is to say in a still unground state. In the first grinding station, the crankshaft is mounted in this case in shell chucks which are attached advantageously to end-side cylindrical portions or to the two outer main bearings of the crankshaft. Naturally, during the grinding of the rod bearings, the crankshaft does not rotate about its defining geometrical longitudinal axis but about a rotational axis that deviates therefrom and is given by the rough contour of the crankshaft at the clamping points. Since, however, the rod bearings have to be ground anyhow by CNC-controlled external cylindrical grinding in the pin-chasing grinding process, according to DE 10 2008 007 175 A1, a corresponding correction in the computer of the grinding machine has to be made. To this end, the crankshaft has to be measured precisely before grinding. When the deviations of the actual rotational axis from the defining geometrical longitudinal axis of the crankshaft are known, this can be sensed by computer and taken into account during CNC grinding. As a result, a crankshaft which has as yet unground main bearings but the rod bearings of which have been ground as if the crankshaft had been rotated about the exact defining geometrical longitudinal axis is present following grinding in the first grinding station.

According to DE 10 2008 007 175 A1, it is only in the second grinding station that the crankshaft is clamped between centers which penetrate into the usual centering bores in the end faces of the crankshaft. These centering bores are made by the crankshaft manufacturer even before the rod bearings are ground and determine the defining geometrical longitudinal axis of each crankshaft.

SUMMARY OF THE INVENTION

The method according to DE 10 2008 007 175 A1 has succeeded in first of all rough- and finish-grinding all of the rod bearings and only then the main bearings in an altered setup in a manner which is still economical. However, the method according to DE 10 2008 007 175 A1 involves considerable effort, because for each crankshaft the position of the rotational axis with respect to the defining geometrical longitudinal axis, said position arising from the clamping of the rough contour at the clamping points, has to be measured precisely. It is therefore the object of the present invention to simplify the known method such that the same high accuracy of the grinding result can still be achieved with much less effort.

According to the method of the invention, the crankshaft to be ground is brought into line with the rotational axis of the associated workpiece rotary drive in a first setup. Then, two supporting members, which are located on the chuck of the associated rotary drive and can move in a radial plane, are positioned at these clamping points and are locked together in this position to form a support in the manner of a prism which is operationally fixed to the chuck. The property of the prismatic support results from the necessarily V-shaped position of the supporting members with respect to one another. A clamping member located radially opposite the supporting members is then positioned, preferably hydraulically, against the crankshaft and presses the crankshaft against the support which is provided by the two supporting members locked firmly together. The primary purpose of the supporting members and the clamping member is to effect the rotary drive of the crankshaft during grinding; this is because the clamping position of the crankshaft is determined by the centers of the rotary drive. However, since particularly dimensionally rigid clamping results from the firm locking of the supporting members, a stiffening and supporting action is also achieved for the crankshaft during grinding. As a result, particular accuracy of the grinding result arises overall, even when deformations of the crankshafts during the grinding of the rod bearings continue to be unavoidable. It is therefore possible to dispense with the addition of a steady seat. The particular type of clamping advantageously results in the crankshaft rotating about its defining geometrical longitudinal axis even during the grinding of the rod bearings. It is therefore advantageously possible to dispense with the circuitous route of a determination by way of computer during CNC grinding.

For the second clamping station, the second setup as per the method known from DE 10 2008 007 175 A1 is retained. Here, the crankshaft is as a rule clamped between centers and set in rotation by a compensating chuck, the clamping jaws of which are all mutually compensating. The reason for this is that as far as possible all main bearings are intended to be ground simultaneously or else in succession in the second setup and the clamping points therefore have to be positioned further out, as usual on a journal and/or on a flange. The resulting low flexural stiffness in the crankshaft requires at most the addition of a steady seat, as a result of which there is a different method of working in the second setup.

The method of the invention also includes measures for achieving coincidence of the defining geometrical longitudinal axis of the crankshaft with the rotational axis of the workpiece rotary drive when the crankshaft is clamped in the first setup (the first grinding station).

The method of the invention provides a preferred procedure when the crankshaft is introduced into the first setup of the grinding machine. The crankshaft is in this case first of all set down on resting shoulders which are fixed to the chuck and is then moved into stable coincidence of the two defining axes in a combined adjusting and lifting movement by the centers of the workpiece headstock and the tailstock.

It is essential that the supporting members in the chuck are radially movable independently of one another and are positioned at the clamping point of the crankshaft in an automatically adaptive manner under the action of a hydraulic fluid that acts equally on both supporting members.

The present invention also provides a grinding machine for carrying out the method according to the invention.

Further aspects of the invention provide advantageous design details of this grinding machine.

As mentioned above, the grinding machine according to the present invention also retains the subdivision into two different setups and thus into two grinding stations, with the configuration of the second grinding station as per DE 10 2008 007 175 A1 being retained.

BRIEF DESCRIPTION OF THE INVENTION

Figure 2:
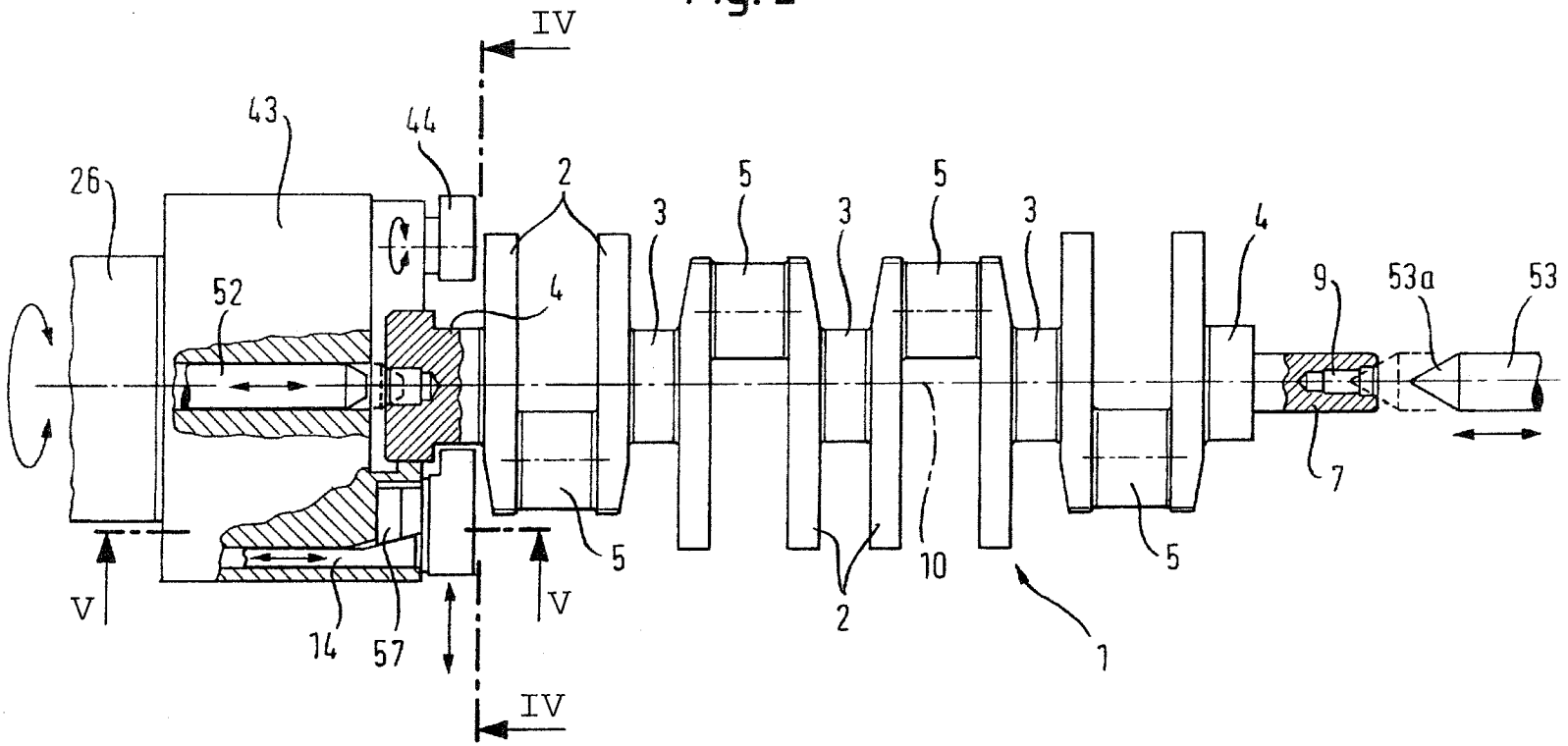
Figure 2A:
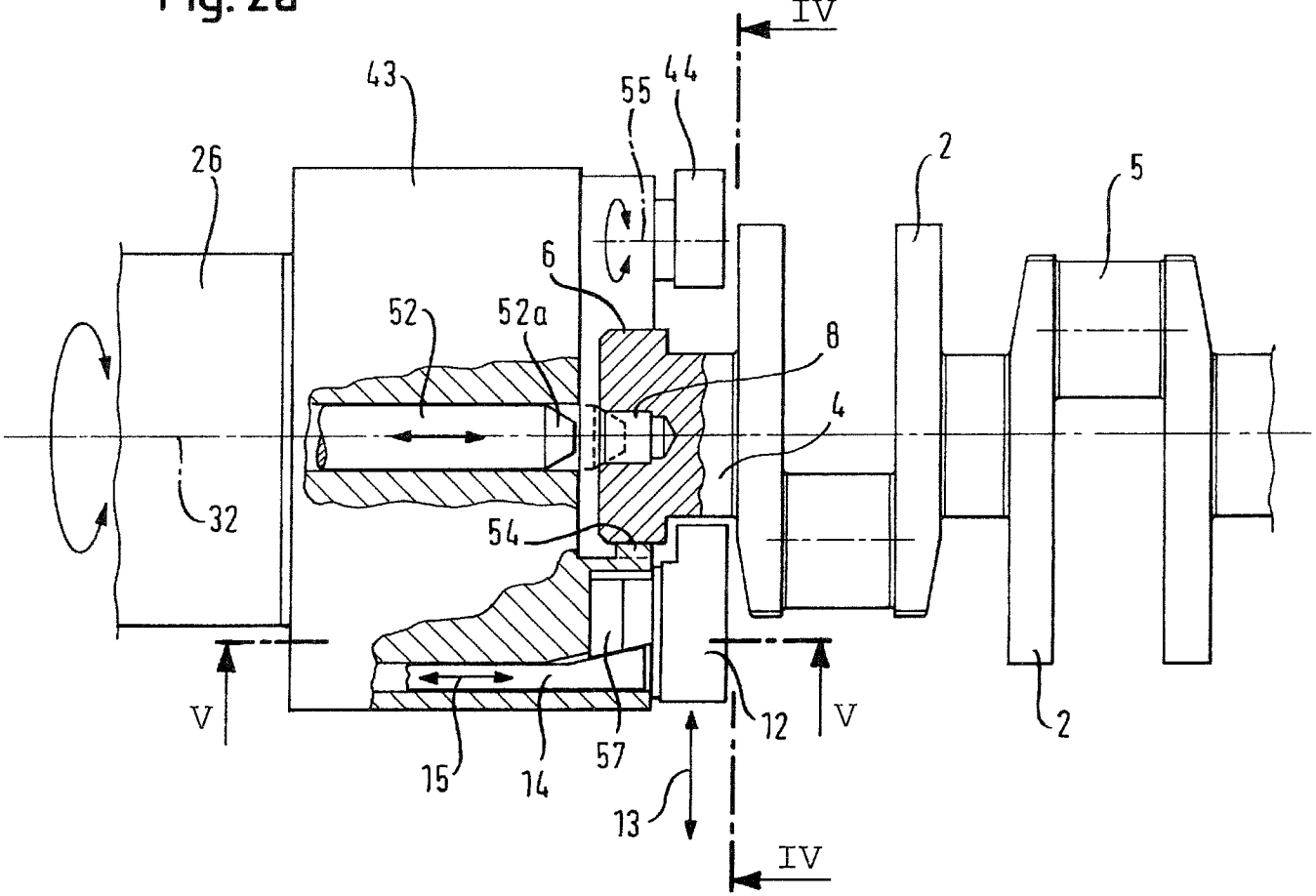
Figure 3:
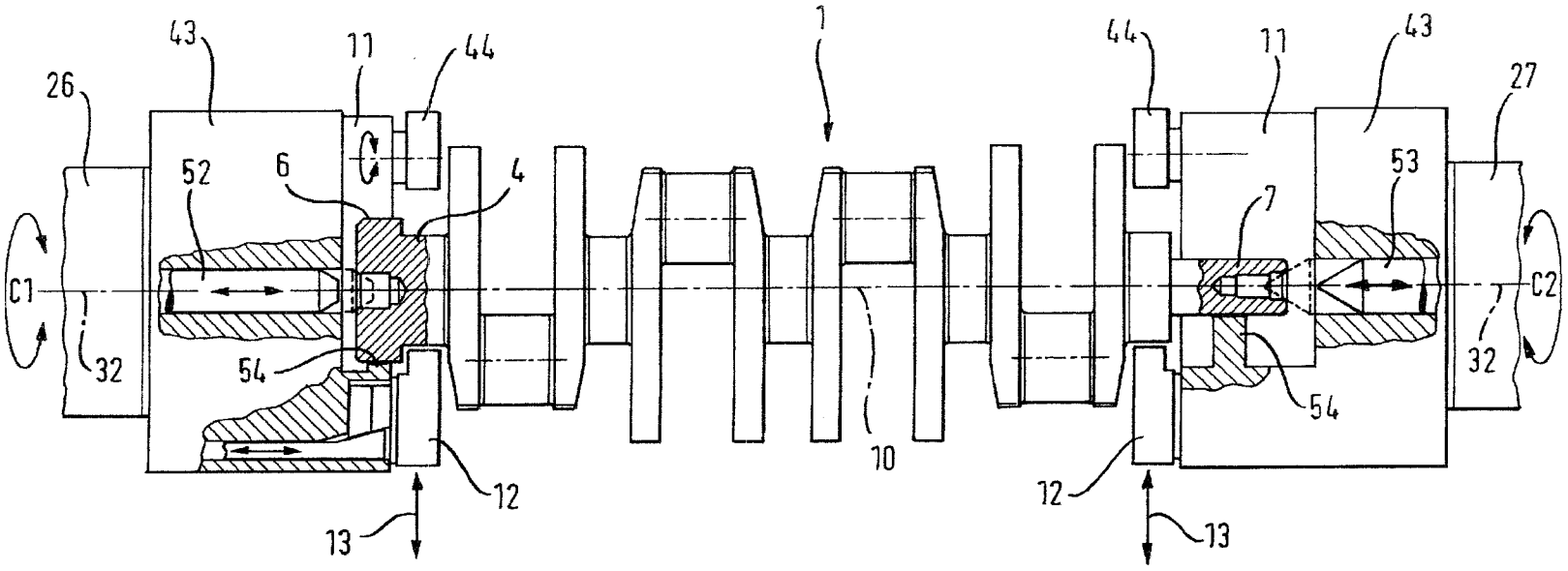
Figure 4:
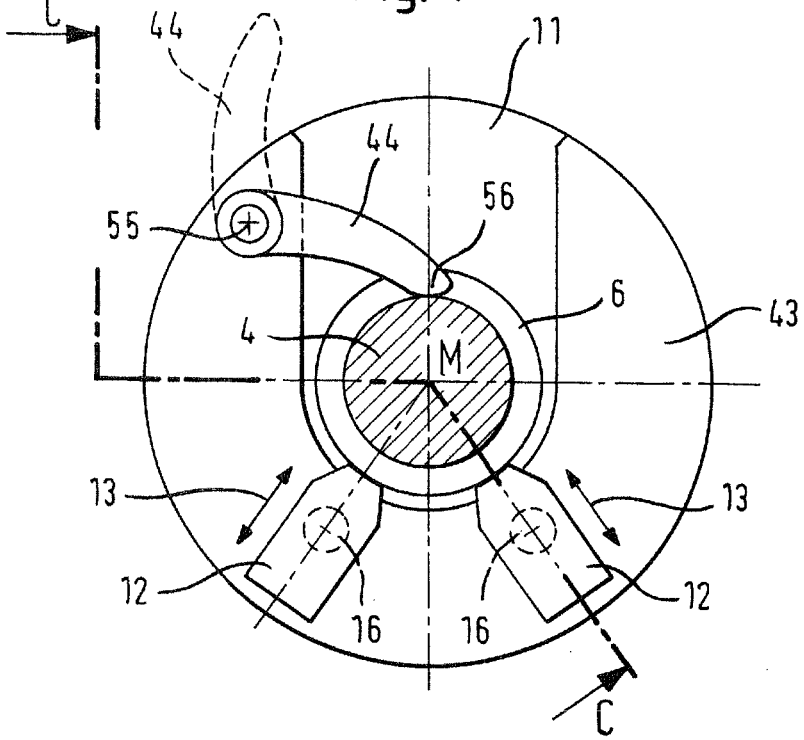
Figure 5:
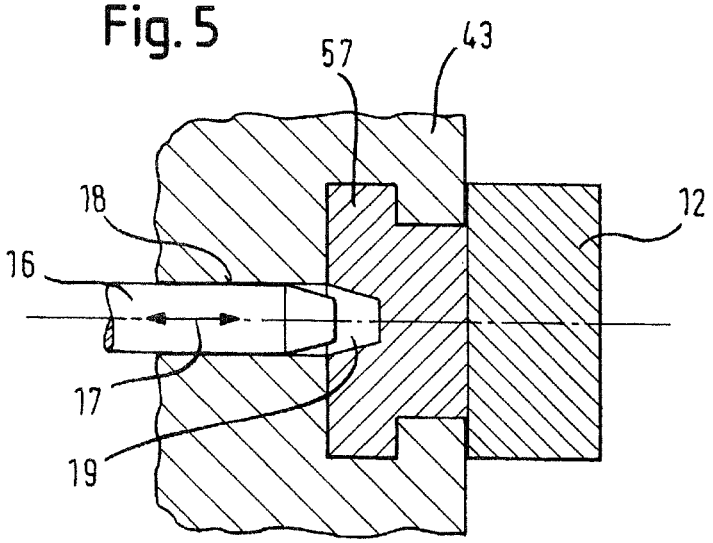

The invention is explained in more detail in the following text on the basis of an exemplary embodiment illustrated in the drawings, in which:

FIG. 1 shows an illustration from above of a grinding machine for carrying out the method according to the invention, FIG. 2 shows the partially sectional side view of a crankshaft having a chuck and explains a first possible way of clamping the crankshaft during the grinding of the rod bearings, FIG. 2*a* shows an enlarged illustration of details from FIG. 2, FIG. 3 shows an illustration corresponding to FIG. 2 of a further possible way of clamping the crankshaft during the grinding of the rod bearings, FIG. 4 shows a section along the line IV-IV in FIG. 2, FIG. 5 shows a partial section along the line V-V in FIG. 2.

FIG. 1 shows by way of example a view from above of a grinding machine, by way of which crankshafts 1 are intended to be ground according to the invention. FIG. 2 illustrates as an example the side view of a conventional four-cylinder crankshaft 1 with an associated chuck 43 which is located in a workpiece headstock 26. The crankshaft 1 has cheeks 2, inner main bearings 3 and outer main bearings 4 and also rod bearings 5. The left-hand end of the illustrated crankshaft 1 ends in a flange 6 and the right-hand end in a journal 7. The crankshaft 1 has a defining geometrical longitudinal axis 10 which forms the center line of all the centered parts of the crankshaft 1, such as main bearings 3, 4, flange 6 and journal 7, and is also decisive for all the operations of cylindrical grinding. The defining geometrical longitudinal axis 10 is already indicated by the manufacturer of the crankshaft blank, as a rule by centering bores 8 and 9, which are provided in the two end faces of the crankshaft 1. The defining geometrical longitudinal axis 10 is thus available during the grinding of the crankshaft 1 as a connecting straight line between the two centering bores 8, 9.

The machine used for grinding such a crankshaft 1 can be described as a whole on the basis of the schematic overview drawing in FIG. 1, because the individual subassemblies and elements are fundamentally familiar to a person skilled in the art. The grinding machine forms a grinding cell 21, which comprises a first grinding station 22 and a second grinding station 23. In this case, the first grinding station 22 is used exclusively to grind the rod bearings 5, while in the second grinding station 23 exclusively the main bearings 3 and 4 are ground. The direction of flow of the crankshafts 1 as they pass through the grinding cell is indicated by the arrow 20; thus the rod bearings 5 are rough- and finish-ground before the main bearings 3 and 4. The two grinding stations 22, 23 are arranged on a common machine bed 24. The machine bed 23 also comprises a machine table 25.

The first grinding station 22 includes a workpiece headstock 26 and a tailstock 27, both of which can be driven synchronously by an electric motor. A crankshaft 1 is clamped between the workpiece headstock 26 and the tailstock 27. Furthermore, the first grinding station includes a cross slide 28 having a grinding headstock 29 on which two grinding spindles 30 having the grinding wheels 31 are located. The cross slide 29 as a whole can be moved in the infeed direction 33, that is to say perpendicular to the defining geometrical longitudinal axis 10 of the clamped crankshaft 1; the grinding spindles 30 located thereon can be moved individually or together in the direction 34, that is to say parallel to the defining geometrical longitudinal axis 10, on the cross slide 29. Moreover, the distance between the grinding spindles 30 can be altered in the direction 34. In this way, all the usual operations for grinding the rod bearings 5 can be carried out, as is known with and without CNC control.

The second grinding station 23 likewise includes a workpiece headstock 36 and a tailstock 37, between which a crankshaft 1 is clamped and driven in rotation. A cross slide 38 belonging to the second grinding station 23 carries, on a common driven spindle 39, a multiple grinding wheel set having grinding wheels 40 which are fed in jointly toward the main bearings 3, 4 during the grinding of the main bearings 3, 4. Moreover, the multiple wheel set can also be moved in the direction 34.

The drive motors for the infeed spindle of the cross slides 28, 38 are designated by 41 and covers which keep the swarf away from the slideways of the grinding stations 22, 23 are designated by 42. The clamping and driving devices for the two workpiece headstocks 26, 36 and of the two tailstocks 27, 37 lie in a common longitudinal axis 32. The longitudinal axis 32 is at the same time the rotational axis (C axis) of the crankshafts 1 during grinding. Measuring devices, which are not illustrated in detail, are provided for operational measurements during the grinding operation.

DE 10 2008 007 175 A1, having common ownership with the present application, discloses the features described thus far of the grinding machine according to the invention, and also the teaching that the crankshaft 1 has to be clamped differently in each grinding station 22, 23 in a manner corresponding to the different use purposes of the two grinding stations 22, 23. For the present application, the known method for clamping in the second grinding station 23 is also taken over from DE 10 2008 007 175 A1. Therefore, in order to grind the main bearings 3, 4, the crankshaft 1 is clamped in the second grinding station 23 between centers which are located on the spindles of the workpiece headstock 36 and of the tailstock 37. The conical end contour of the centers engages into the centering bores 8 and 9 at the ends of the crankshaft 1 and thus the defining geometrical longitudinal axis 10 of the crankshaft 1 is in coincidence with the common longitudinal axis 32 of the workpiece headstock 36 and the tailstock 37, said axis being at the same time the rotational axis of the crankshaft 1 during grinding.

The crankshaft 1 clamped between the centers is rotationally driven by a drive having compensating chucks. In such a chuck, a group of at least two clamping jaws is actuated preferably hydraulically, with all the clamping jaws being connected to the same hydraulic fluid supply line and being positioned in the radial direction on a part of the crankshaft 1 which is located in the common longitudinal extent of the main bearings 3, 4. Particularly the flange 6 or the journal 7 are suitable as clamping points, because as a result all of the main bearings are exposed for grinding. The outer contour of the clamping points does not in this case have to be exactly centrally symmetrical with respect to the defining geometrical longitudinal axis 10 of the crankshaft 1; rather, it can be an unground rough contour; this is because clamping between the centers ensures that the crankshaft 1 is rotated in each case about its defining geometrical longitudinal axis 10. Although the clamping jaws of the compensating chuck can be moved individually on their own, they can be mutually compensating via the hydraulic pressure medium. Thus, each clamping jaw is positioned with the same force at the clamping point of the crankshaft 1. In this case, the clamping jaws only drive the crankshaft 1 in rotation; however, since they are positioned in a flexibly compensating manner, they exert no or only a little stiffening clamping action on the crankshaft 1 and counteract buckling of the crankshaft 1 during grinding. In order to avoid errors with respect to diameter, roundness, true running and centricity, it is absolutely necessary, when the main bearings 3, 4 are being ground in the second clamping station 2, for the crankshaft 1 to be supported in its central longitudinal region by a steady seat.

An example for such a compensating chuck is described in detail in DE 10 2008 007 175 A1 by way of FIG. 8. All of the embodiments present therein for clamping and driving the crankshaft 1 in rotation in the second grinding station 23 are also included in the content of the present application. When these compensating chucks are used, the main bearings 3, 4 can be rough- and finish-ground reliably in the second grinding station 23.

However, in a manner deviating from the prior art according to DE 10 2008 007 175 A1, in the first clamping station 22 for grinding the rod bearings 5, the crankshaft 1 is clamped and driven in rotation in such a way as is illustrated by way of example and largely schematically in FIGS. 2 to 5. The sectional illustration in the left-hand region of FIG. 2 corresponds in this case to the section line CMC in FIG. 4, with M being the center point of the crankshaft cross section on the defining geometrical longitudinal axis 10. FIGS. 2 and 2*a* show the chuck 43 of a workpiece headstock 26, in which a center 52 is axially movable. The front end, facing the crankshaft 1, of the center 52 is formed as a conical end contour 52*a* and thus facilitates insertion into the associated centering bore 8 in the crankshaft 1. The tailstock 27, too, can be formed with a chuck 43 of this kind, cf. in FIG. 3 the center 53 having the conical end contour and the associated centering bore 9. As is shown in FIG. 4, a U-shaped pocket 11, which, according to FIGS. 2, 2*a* and 3, is exposed for the flange 6 of the crankshaft 1 and the journal 7, is formed on that end face of the chuck 43 which faces the crankshaft 1. According to FIGS. 2 and 3, the crankshaft 1 rests in each case on two resting shoulders 54 which project in the form of protuberances from the base of the pocket 11, extend toward one another in a manner inclined in a V shape and form together a supporting prism which is stationary with respect to the chuck 43. In the illustration in FIG. 4, the resting shoulders 54 are located behind the supporting members 12 and are therefore not visible.

Also provided in the chuck 43 are two axial slides 14, which are axially movable in the direction of the double arrow 15 under the action of a hydraulic fluid. With regard to the rotational axis 32 of the chuck 43, the two axial slides 14 are arranged in a manner offset in a V shape at an angle of about 60 to 120 degrees to one another, as can be seen from FIG. 4. The end faces of the axial slides 14 are arranged behind supporting members 12, which are likewise arranged in a V shape with respect to one another, also have the function of clamping jaws and are radially movable with respect to the rotational axis 32, cf. the double arrow 13. Each axial slide 14 is operatively connected via inclined surfaces to a radial slide 57 which is mounted in the chuck 43 in a movable manner in the radial direction. Each radial slide 57 is in turn screwed to a supporting member 12 which projects out of the chuck 43. Each radial slide 57 forms a functional unit with its supporting member 12; the divided configuration makes it possible to change the supporting member 12 easily when the crankshaft 1 is intended to be clamped at a clamping point having a different diameter.

The double arrow 15 indicates that the two axial slides 14 can be moved axially in two opposite directions by a hydraulic fluid that acts equally on them both and is connected to the same supply line. In the case of a movement to the left in FIG. 2*a*, the radial slides 57 are moved inward in the direction of the rotational axis 32 via the inclined surfaces which are in contact with one another. As a result, the supporting members screwed to the radial slides 57 also move in the same direction and come into abutment at the clamping point of the crankshaft 1, in the case of FIG. 2, at the outer main bearing 4 located on the left-hand side. In the case of a movement of the axial slides 14 in the opposite direction (to the right in FIG. 2*a*), the supporting members 12 move radially outward again. The pressure force on the supporting members 12 can be regulated by various pressure regulators in the hydraulic circuit.

Two locking pins 16 are provided, parallel to the axial slides 14 and in a manner offset radially inward, in axially extending bores 18 which are arranged at the same angle with respect to the rotational axis 32, cf. the sectional illustration according to FIG. 5. The locking pins 16 can be displaced in a controlled manner in two opposite directions 17, cf. the double arrow 17. In its activated position, one locking pin 16 engages by way of its conical front end into a trapezoidal groove 19, which is located in the longitudinal direction and direction of movement of the associated radial slide 57. The radial slide 57 is then clamped firmly in a desired position. The locking pins 16 can be activated and restored by mechanical, hydraulic, electrical or pneumatic means, wherein different means for activation and restoring are suitable, such as hydraulic means for activation and springs for restoring. The same possible ways of adjustment also exist for the axial slide 14.

As is apparent particularly from FIG. 4, a pivotable clamping member 44 in the form of a pivot arm is provided on that side of the chuck 43 that is opposite the supporting members 12. The pivot axis of said clamping member 44 is designated by 55 and its active end by 56. FIG. 4 shows the clamping position of the clamping member 44 by way of solid lines, while the released position is illustrated by way of dashed lines. The dimensions and installation conditions are selected such that, on activation, the active end 56 of the clamping member 44 rests against a point of the crankshaft 1L which is located on the extended angle bisector between the supporting members 12. The same means as for the locking pins 16 come into question for activating the clamping member 44.

With the grinding machine described, the grinding method is carried out as follows:

The crankshaft 1 to be ground consists of steel or cast materials, can be cast or forged and is in the unground rough state; it is rough-machined by removing chips, that is to say primarily by turning, drilling or trochoidal milling. The crankshaft 1 is first moved by a transporting apparatus into the first grinding station 22 and is clamped there between the workpiece headstock 26 and the tailstock 27. An embodiment is shown in which the workpiece headstock 26 and the tailstock 27 are both equipped with chucks 43 according to FIGS. 2 to 5, cf. FIG. 3. Thus, each of the chucks 43 is also provided with a center 52, 53. Before the crankshaft 1 is introduced, the workpiece headstock 26 and the tailstock 27 are set, with the centers 52, 53 retracted axially inward, to an axial spacing which corresponds to the length of the crankshaft 1. The rotational axes of the chucks 42 are moved into a position in which the supporting members 12 and the latching shoulders 14 are in their bottom position.

Then, the crankshaft 1 is lowered into a horizontal position, preferably from above, between the workpiece headstock 26 and the tailstock 27 and comes to rest on the latching shoulders 54, which together form a prism which is stationary with respect to the chuck 43. In the case of FIG. 3, the crankshaft 1 rests by way of the flange 6 on the latching shoulders 54 of the workpiece headstock 26 and by way of the journal 7 on the latching shoulders 54 of the tailstock 27. The radial distance between the centers 52, 53 located in the rotational axis 32 and the latching shoulders 54 is selected in this case such that the defining geometrical longitudinal axis 10 of the crankshaft 1 is slightly lower than the common rotational axis of the workpiece headstock 26 and the tailstock 27. Accordingly, the centers 52, 53 are located opposite the centering bores 8, 9 within their opening widths. The supporting members 12 of the two chucks 43 are located at this point in time at a spacing below the two outer main bearings. Since the crankshaft 1 rests with its unground rough contour on the latching shoulders 54 of the chucks, in this phase of clamping the defining geometrical longitudinal axis 10 of the crankshaft 1 will not extend sufficiently precisely parallel to the common rotational axis 32 of the workpiece headstock 26 and the tailstock 27. The correction is made in the next phase.

To this end, the two centers 52, 53 are extended and penetrate into the centering bores 8, 9, this being possible on account of the conical end contours 52*a*, 53*a* of the centers 52, 53. The centers 52, 53 come into abutment against the inner walls of the centering bores 8, 9 and exert a lifting and adjusting action on the crankshaft 1. The position of the crankshaft 1 is thus corrected in height and laterally. When the centers 8, 9 have been extended fully, the crankshaft 1 is lifted off the latching shoulders 54 and its defining geometrical longitudinal axis 10 extends precisely in the common rotational axis 12 of the workpiece headstock 26 and the tailstock 27 (state of coincidence). In this phase, the supporting members 12 of the two chucks 43 are still located at a distance below the outer main bearings 4. However, the distance is so small that it cannot be reproduced to scale in the figures.

By actuation of the axial slides 14 in the two chucks 43, the supporting members 12 are subsequently moved up to the two outer main bearings 4. Since the supporting members 12 can automatically compensate their position with respect to one another, the same pressure force arises for the two supporting members 12 of a chuck on abutment against the crankshaft 1, even if the positions of the supporting members 12—on account of the rough contour of the outer main bearings 4—differ from one another. The magnitude of the pressure force is selected such that it supports, but does not endanger, the setup of the crankshaft 1 in the centers 52, 53, and is sufficient for the subsequent function of the supporting members 12 as chucks during the turning of the crankshaft 1. When this abutment position has been reached, the locking pins 16 in both chucks 43 are activated, said locking pins 16 entering the longitudinal grooves 19 located on the radial slides 57 and locking the radial slides 57 together with the associated supporting member 12 in the abutment position.

It should also be noted that the crankshaft 1 could also be placed straight onto the bottom supporting members 12 when it is introduced into the grinding station 22, before they are moved up to the crankshaft. The stationary latching shoulders 54 would then be dispensable. However, it is deemed more reliable to have the transporting operation end at stationary latching shoulders 54 and to relieve the movable supporting members 12 to this extent of the task of first deposition.

In their locked position, the two supporting members 12 of each chuck 43, on account of their V-shaped arrangement, together likewise form a support in the manner of a prism for the crankshaft 1. This support is operationally fixed to the chuck 43, with the pressure force of the locking pins 16 being set such that the latter cannot release during further operation; this also applies for a hydraulically generated locking force. The chuck 43 of the first grinding station 22 differs in this respect clearly from the chucks in the second grinding station 23, in the case of which all the chucks remain mutually compensating even during the rotation of the crankshaft 1 during grinding.

In this state, the two supporting members on each chuck 43 act only as a fixed supporting prism which supports the setup of the resting crankshaft 1 in the centers 52, 53. In order to continue clamping, the pivotable clamping member 44 is now transferred out of its released position and into the clamping position, cf. FIG. 4. The pivotable clamping member 44 and the two supporting members 12 now assume the function of chucks which have to ensure the rotation and support of the crankshaft 1. Since the active end 56 of the clamping member 44 lies approximately on the straight line of the angle bisector between the supporting members 12, cf. FIG. 4, the action of the driving forces on the circumference of the outer main bearings 4 is largely uniform. The supporting members 12 remain firmly locked to the chuck 43 while the crankshaft 1 rotates during grinding and reliably absorb the force exerted by the pivotable clamping member 44, without the coincidence, brought about by the centers 52, 53, of the defining geometrical longitudinal axis 10 of the crankshaft with the rotational axis 12 being endangered. The crankshaft 1 is clamped in a manner running exactly along this longitudinal axis 10 and cannot be pushed out of the center.

In support of this is the fact that the crankshaft 1 is clamped in the first grinding station 22 at the outer main bearings 4. These form the clamping points which are moved furthest inward toward the central longitudinal region of the crankshaft 1, and in the case of which all of the rod bearings 5 can be rough- and finish-ground in one setup. The free length of the crankshaft 1 between the clamping points is at its shortest in this case; in conjunction with the supporting members 12 locked firmly in the manner of a prism, this leads to the fact that the crankshaft 1 does not buckle under the pressure of the grinding wheels. Therefore, it is possible to dispense with the addition of a steady seat. In the case of a relatively small number of rod bearings, for example two or three, of a thus shorter crankshaft or in the case of lower requirements placed on grinding accuracy, it is also in principle possible in the first grinding station 22 to clamp the crankshaft 1 at the flange and/or at the journal and to carry out the grinding in the same manner as described.

When the rod bearings 5 have been finish-ground, the crankshaft 1 still has to be transferred into the second grinding station 23, in which the second setup is carried out. Since all of the main bearings 3, 4 are intended to be rough- and finish-ground simultaneously as far as possible, the clamping can only be carried out at the outer ends of the crankshaft 1. Therefore, in the second grinding station 23, the clamping jaws of the compensating chuck have to be able to yield individually automatically when the crankshaft 1L rotates. As a result, the secure hold of the crankshaft 1 between the centers of the workpiece headstock 36 and the tailstock 27 is not always ensured, and so the addition of a steady seat in the central region of the crankshaft 1 is advantageous in each case. In spite of the change in the setup, the advantages of the method according to the invention outweigh those of the known method according to EP 1 181 132 B1. Specifically, since the considerable deformations during rough- and finish-grinding of the rod bearings 5 occur right at the beginning and can be largely eliminated again during the subsequent rough- and finish-grinding of the main bearings 3, 4, an increase in grinding accuracy is achieved overall in each case.

The invention clamed is:

1. A method for grinding main and rod bearings of a crankshaft by external cylindrical grinding in a grinding machine which has workpiece rotary drives and chucks located thereon, comprising:

a) in a first setup, rough- and finish-grinding all the rod bearings;

b) then, bringing the crankshaft into a second setup, and rough- and finish-grinding all the main bearings in the second setup;

c) in both setups, clamping the crankshaft at two unground clamping points which are spaced axially apart from one another and have a rough contour;

d) to achieve the second setup, operating a compensating chuck of said chucks to effect actuation of a first rotary drive, among said workpiece rotary drives, and cause rotation about a defining geometrical longitudinal axis of the crankshaft;

e) to achieve the first setup, bringing the defining geometrical longitudinal axis of the crankshaft into line with the rotational axis of the first rotary drive;

f) at one or more of the two clamping points of the first setup, positioning two supporting members, which are located on a second chuck of the first rotary drive and are radially movable, at said clamping points and locking said supporting members together in said position to form a support in a configuration of a prism which is operationally fixed to the second chuck;

g) positioning at least one clamping member, arranged radially opposite the supporting members, at the clamping point and thereby securing the position of the crankshaft on the supporting members; and h) setting the rotary drive of the first setup in rotation, wherein an axis of said rotation of said rotary drive of the first setup is said defining geometrical longitudinal axis of the crankshaft.

2. The method as claimed in claim 1, wherein clamping of the crankshaft is at both clamping points in the first setup and is by means of the supporting members and at least one clamping member of a third chuck.

3. The method as claimed in claim 2, wherein, in the grinding machine carrying out the method, the crankshaft is rotatably clamped at its ends between a workpiece headstock and a tailstock for being driven in rotation, in an adjusting operation coincidence is effected between the defining geometrical longitudinal axis of the crankshaft and the rotational axis of the workpiece headstock and the tailstock and said coincidence is locked in by effecting positively locking engagement between centers of end faces of the crankshaft and the supporting members and drive parts of the workpiece headstock and the tailstock.

4. The method as claimed in claim 3, wherein the positively locking engagement is effected by providing centers of the workpiece headstock and workpiece tailstock, respectively, as a conical end contour formed as a rotatable centering part, and by providing matching centering bores at said end faces of the crankshaft, and engaging said centers in said matching centering bores.

5. The method as claimed in claim 4, further comprising axially moving the centers within at least one of a headstock chuck of the workpiece headstock and a tailstock chuck of the tailstock.

6. The method as claimed in claim 5, wherein, in order to introduce the crankshaft into the first setup of the grinding machine, in order to adjust said defining geometrical longitudinal axis of the crankshaft, and for the purposes of said clamping and rotating said crankshaft, the following method steps are carried out:

a) with the centers retracted, setting the workpiece headstock and the tailstock at a spacing from one another which spacing corresponds to a length of the crankshaft;

b) introducing the crankshaft by a transporting apparatus, in an approximately horizontal position between the workpiece headstock and the tailstock and setting down the crankshaft on latching shoulders of the headstock chuck, wherein height adjustment is selected such that the defining geometrical longitudinal axis of the crankshaft is located slightly lower than the rotational axis of the workpiece headstock and the tailstock, and the conical end contours of the centers of the workpiece headstock and the tailstock are located outside the matching centering bores in the end faces of the crankshaft and opposite the centering bores;

c) extending the centers to penetrate into the centering bores whereby the crankshaft is raised and its defining geometrical longitudinal axis is brought into stable coincidence with the common rotational axis of the workpiece headstock and the tailstock;

d) subsequently, positioning the supporting members at the clamping points of the crankshaft, and by positioning the at least one clamping member, clamping the crankshaft firmly to the supporting members; and e) finally, starting the rotary drive and grinding operation.

7. The method as claimed in claim 1, further comprising radially moving the supporting members in the headstock chuck independently of one another and positioning the supporting members at the clamping point of the crankshaft in an automatically adaptive manner under the action of a hydraulic fluid that acts equally on both supporting members.

8. The method as claimed in claim 1, wherein the at least one clamping member is actuated hydraulically.

* * * * *